US011527350B2

(12) United States Patent
Shiga et al.

(10) Patent No.: US 11,527,350 B2
(45) Date of Patent: Dec. 13, 2022

(54) MULTILAYER COIL COMPONENT

(71) Applicant: TDK CORPORATION, Tokyo (JP)

(72) Inventors: Yuto Shiga, Tokyo (JP); Hajime Kato, Tokyo (JP); Kazuya Tobita, Tokyo (JP); Youichi Kazuta, Tokyo (JP); Noriaki Hamachi, Tokyo (JP); Makoto Yoshino, Tokyo (JP)

(73) Assignee: TDK CORPORATION, Tokyo (JP)

( * ) Notice: Subject to any disclaimer, the term of this patent is extended or adjusted under 35 U.S.C. 154(b) by 590 days.

(21) Appl. No.: 16/576,193

(22) Filed: Sep. 19, 2019

(65) Prior Publication Data

US 2020/0098507 A1 Mar. 26, 2020

(30) Foreign Application Priority Data

Sep. 21, 2018 (JP) ..... JP2018-177501

(51) Int. Cl.
*H01F 27/28* (2006.01)
*H01F 41/04* (2006.01)
*H01F 27/32* (2006.01)

(52) U.S. Cl.
CPC ..... *H01F 27/2804* (2013.01); *H01F 27/323* (2013.01); *H01F 41/041* (2013.01); *H01F 2027/2809* (2013.01)

(58) Field of Classification Search
CPC ..... H01F 27/2804; H01F 2027/2809; H01F 41/041; H01F 27/323
See application file for complete search history.

(56) References Cited

U.S. PATENT DOCUMENTS

| | | | | |
|---|---|---|---|---|
| 6,580,350 | B1 | 6/2003 | Kobayashi | |
| 8,362,865 | B2 | 1/2013 | Banno | |
| 2009/0256668 | A1 | 10/2009 | Noma et al. | |
| 2016/0141102 | A1 * | 5/2016 | Tseng | H01F 27/292 336/200 |
| 2017/0103848 | A1 | 4/2017 | Yoneda et al. | |

FOREIGN PATENT DOCUMENTS

| | | | |
|---|---|---|---|
| JP | 2000286125 | A | 10/2000 |
| JP | 2004095860 | A * | 3/2004 |
| JP | 2012-129364 | A | 7/2012 |
| JP | 2012-204475 | A | 10/2012 |
| JP | 2017-073536 | A | 4/2017 |
| WO | 2009081865 | A1 | 7/2009 |
| WO | 2010/079804 | A1 | 7/2010 |

* cited by examiner

*Primary Examiner* — Dinh T Le
(74) *Attorney, Agent, or Firm* — Oliff PLC

(57) ABSTRACT

A multilayer coil component includes an element body including a plurality of laminated insulator layers, and a coil disposed in the element body. The coil includes a first coil conductor having a first inner diameter, a second coil conductor having a second inner diameter smaller than the first inner diameter, and a connection conductor connecting the first coil conductor and the second coil conductor. The second coil conductor is adjacent to the first coil conductor in a direction in which the plurality of insulator layers are laminated. The connection conductor has a shape along the first coil conductor and the second coil conductor.

3 Claims, 5 Drawing Sheets

MULTILAYER COIL COMPONENT

BACKGROUND OF THE INVENTION

1. Field of the Invention

The present invention relates to a multilayer coil component.

2. Description of Related Art

Known multilayer coil components include an element body including a plurality of laminated insulator layers and a coil disposed in the element body (for example, refer to Japanese Unexamined Patent Publication No. 2017-073536). The coil includes a plurality of coil conductors and a connection conductor connecting the coil conductors adjacent to each other.

SUMMARY OF THE INVENTION

An object of one aspect of the present invention is to provide a multilayer coil component that suppresses short-circuiting between coil conductors and reduction in an inductance value.

An electronic component according to the one aspect includes an element body including a plurality of laminated insulator layers, and a coil disposed in the element body. The coil includes a first coil conductor, second coil conductor, and a connection conductor. The first coil conductor has a first inner diameter. The second coil conductor has a second inner diameter smaller than the first inner diameter, and is adjacent to the first coil conductor in a direction in which the plurality of insulator layers are laminated. The connection conductor connects the first coil conductor and the second coil conductor, and has a shape along the first coil conductor and the second coil conductor.

In the multilayer coil component, an inductance value is increased by increasing the number of winding of a coil. In this case, as the number of winding of the coil increases, the number of coil conductors also increases. However, if the number of coil conductors increases, an interval between the coil conductors adjacent to each other narrows, which may result in short-circuiting between the coil conductors adjacent to each other.

In the one aspect, the second inner diameter is smaller than the first inner diameter. Therefore, as compared with a configuration in which the inner diameters of all the coil conductors are the same, the interval between the coil conductors adjacent to each other tends not to narrow in the one aspect. Consequently, the first coil conductor and the second coil conductor tend not to short-circuit.

The connection conductor is disposed in the element body by sintering conductive paste filled into a through-hole formed in an insulator material layer for obtaining an insulator layer, for example. The through-hole is formed in the insulator material layer by laser processing, for example. In this case, the connection conductor has a cylindrical shape or a frustum shape. By increasing an inner diameter of the through-hole, a diameter of the connection conductor is increased, and connectivity between the coil conductors and the connection conductor is secured. However, in a case in which the diameter of the connection conductor is large, a part of the connection conductor may extend to the inside of the coil. In a configuration in which a part of the connection conductor extends to the inside of the coil, an inner area of the coil is reduced, a magnetic flux generated in the coil is reduced, and the inductance value is reduced.

In the one aspect, the connection conductor has the shape along the first coil conductor and the second coil conductor. In a configuration in which the connection conductor has the shape along the first coil conductor and the second coil conductor, for example, a length of the connection conductor in a direction along the first coil conductor and the second coil conductor is increased, so that connectivity between the first and second coil conductors and the connection conductor is secured. Therefore, in the one aspect, even in a case in which the connectivity between the first and second coil conductors and the connection conductor is secured, the connection conductor tends not to extend to the inside of the coil. Consequently, the one aspect suppresses the reduction of the inductance value.

In the one aspect, the coil may include a plurality of the first coil conductors, a plurality of the second coil conductors, and a plurality of the connection conductors. The plurality of first coil conductors and the plurality of second coil conductors may be alternately disposed in the direction in which the plurality of insulator layers are laminated. The plurality of connection conductors may not overlap each other when viewed from the direction in which the plurality of insulator layers are laminated.

In a case of manufacturing a multilayer coil component where a plurality of connection conductors overlap each other when viewed from a direction in which a plurality of insulator layers are laminated, that is, positions of the plurality of connection conductors are concentrated when viewed from the direction in which the plurality of insulator layers are laminated, the following events may occur.

In a region where conductor material layers for obtaining the connection conductors are concentrated when viewed from a direction in which insulator material layers are laminated, a large pressure acts on the insulator material layers. Consequently, in regions of the coil conductors overlapping the connection conductors when viewed from the direction in which the plurality of insulator layers are laminated, an interval between the coil conductors adjacent to each other tends to narrow.

In a configuration in which the plurality of connection conductors do not overlap each other when viewed from the direction in which the plurality of insulator layers are laminated, in regions of the coil conductors overlapping the connection conductors when viewed from the direction in which the plurality of insulator layers are laminated, an interval between the coil conductors adjacent to each other tends not to narrow. Therefore, the configuration in which the plurality of connection conductors do not overlap each other when viewed from the direction in which the plurality of insulator layers are laminated further suppresses the short-circuiting between the coil conductors adjacent to each other.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
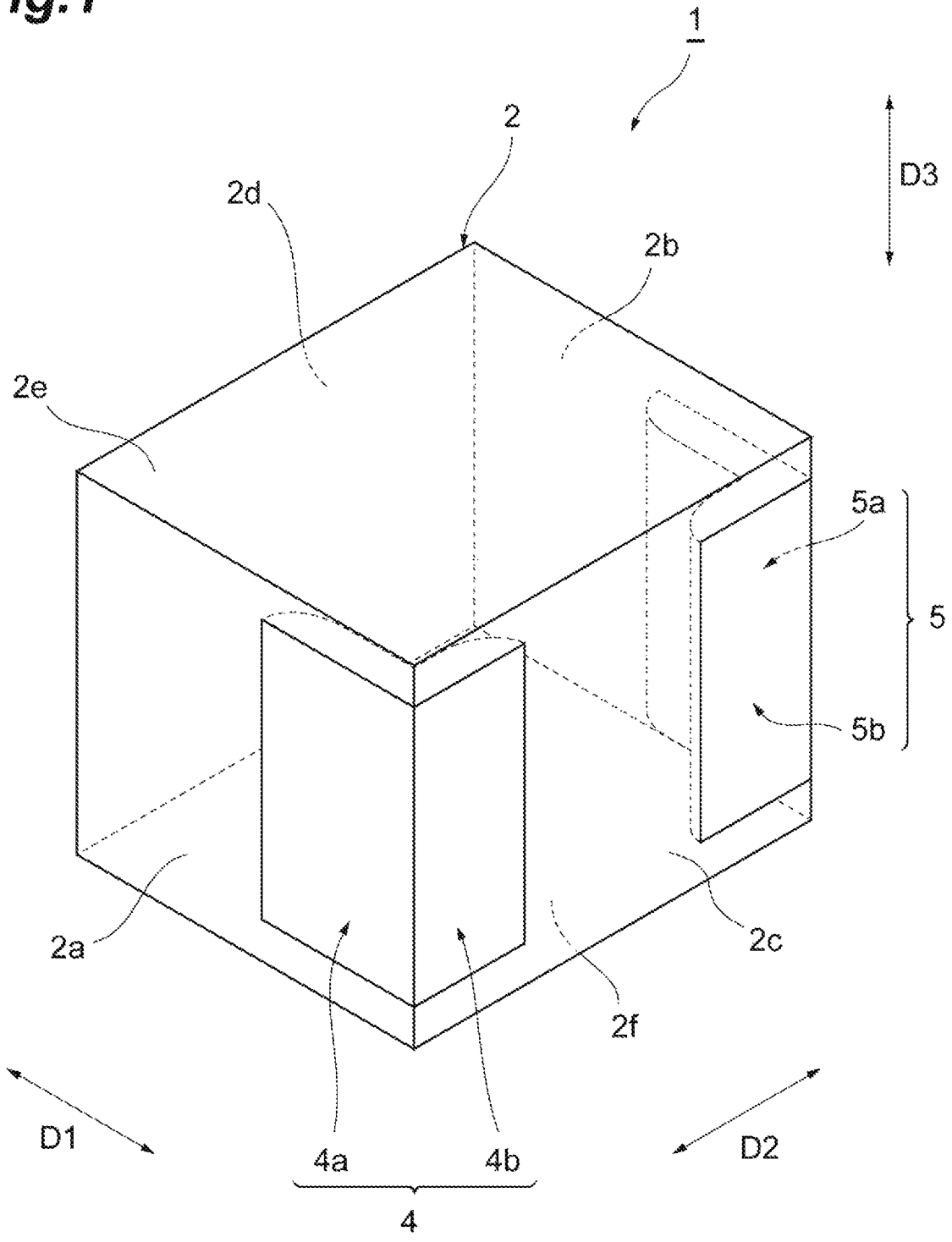
FIG. 1 is a perspective view illustrating a multilayer coil component according to an embodiment.

Hereinafter, embodiments of the present invention will be described in detail with reference to the accompanying drawings. In the following description, the same elements or elements having the same functions are denoted with the same reference numerals and overlapped explanation is omitted.

Figure 2:
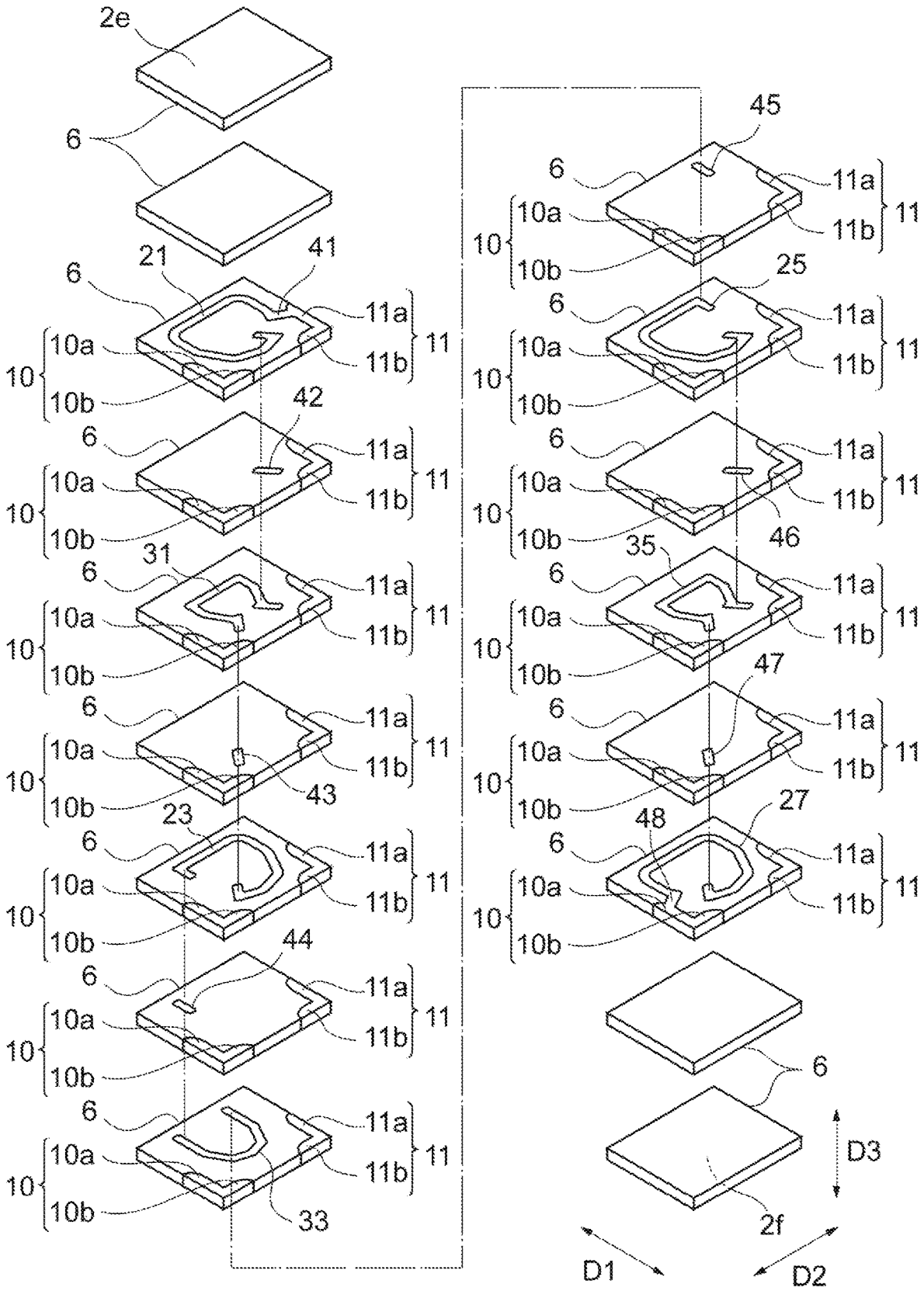
FIG. 2 is an exploded perspective view illustrating configurations of an element body, coil conductors, and connection conductors.
Figure 3:
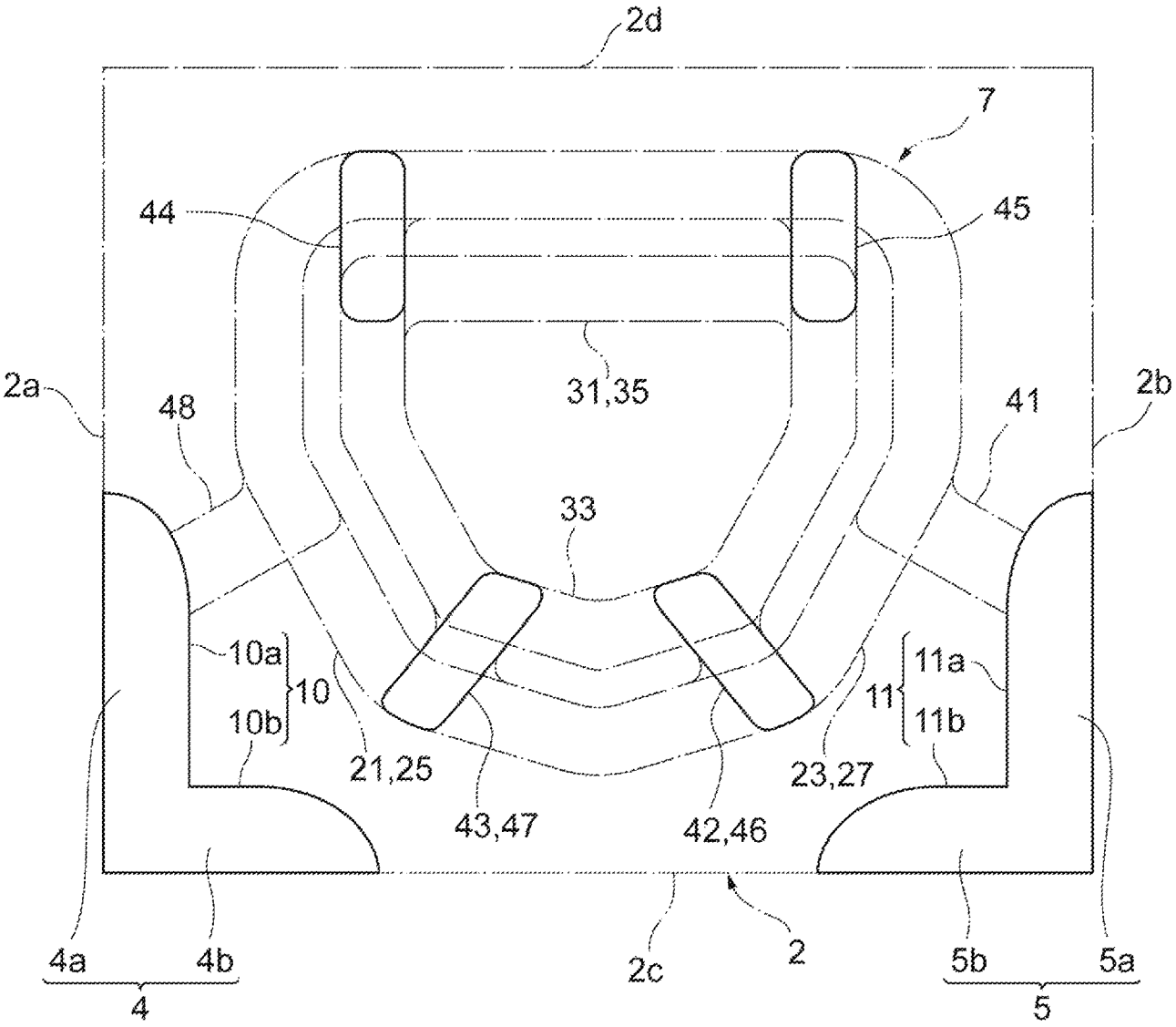
FIG. 3 is a diagram illustrating terminal electrodes, coil conductors, and connection conductors.

A configuration of a multilayer coil component 1 according to the present embodiment will be described with reference to FIGS. 1 to 3. FIG. 1 is a perspective view illustrating the multilayer coil component according to an embodiment. FIG. 2 is an exploded perspective view illustrating configurations of an element body, a coil conductor, and a connection conductor. FIG. 3 is a diagram illustrating a terminal electrode, a coil conductor, and a connection conductor.

As illustrated in FIG. 1, a multilayer coil component 1 includes an element body 2 of a rectangular parallelepiped shape and a pair of terminal electrodes 4 and 5. The pair of terminal electrodes 4 and 5 are disposed on both ends of the element body 2. The rectangular parallelepiped shape includes a rectangular parallelepiped shape in which corners and ridges are chamfered, and a rectangular parallelepiped shape in which the corners and ridges are rounded.

The element body 2 includes a pair of end surfaces 2*a* and 2*b* opposing each other, a pair of principal surfaces 2*c* and 2*d* opposing each other, and a pair of side surfaces 2*e* and 2*f* opposing each other. A direction in which the pair of principal surfaces 2*c* and 2*d* opposes each other, that is, a direction parallel to the end surfaces 2*a* and 2*b* is a first direction D1. A direction in which the pair of end surfaces 2*a* and 2*b* opposes each other, that is, a direction parallel to the principal surfaces 2*c* and 2*d* is a second direction D2. A direction in which the pair of side surfaces 2*e* and 2*f* opposes each other is a third direction D3. In the present embodiment, the first direction D1 is a height direction of the element body 2. The second direction D2 is a longitudinal direction of the element body 2 and is orthogonal to the first direction D1. The third direction D3 is a width direction of the element body 2 and is orthogonal to the first direction D1 and the second direction D2.

The pair of end surfaces 2*a* and 2*b* extends in the first direction D1 in such a manner as to couple the pair of principal surfaces 2*c* and 2*d*. The pair of end surfaces 2*a* and 2*b* also extends in the third direction D3, that is, a short side direction of the pair of principal surfaces 2*c* and 2*d*. The pair of side surfaces 2*e* and 2*f* extends in the first direction D1 in such a manner to couple the pair of principal surfaces 2*c* and 2*d*. The pair of side surfaces 2*e* and 2*f* also extends in the second direction D2, that is, a long side direction of the pair of end surfaces 2*a* and 2*b*. The multilayer coil component 1 is solder-mounted, for example, on an electronic device. The electronic device includes a circuit board or an electronic component, for example. In the multilayer coil component 1, the principal surface 2*c* opposes the electronic device. The principal surface 2*c* is arranged to constitute a mounting surface. The principal surface 2*c* is the mounting surface.

As illustrated in FIG. 2, the element body 2 is configured by laminating a plurality of insulator layers 6 in the third direction D3. The element body 2 includes the plurality of laminated insulator layers 6. In the element body 2, a direction in which the plurality of insulator layers 6 are laminated is matched with the third direction D3. In the actual element body 2, the insulator layers 6 are integrated in such a manner that boundaries between the insulator layers 6 cannot be visualized. Each insulator layer 6 includes a magnetic material, for example. The magnetic material includes an Ni—Cu—Zn based ferrite material, an Ni—Cu—Zn—Mg based ferrite material, or a Ni—Cu based ferrite material, for example. The magnetic material configuring each insulator layer 6 may include an Fe alloy. Each insulator layer 6 may include a non-magnetic material. The non-magnetic material includes a glass ceramic material or a dielectric material, for example. In the present embodiment, each insulator layer 6 includes a sintered body of a green sheet containing a magnetic material.

The terminal electrode 4 is disposed to be closer to the end surface 2*a* of the element body 2. The terminal electrode 5 is disposed to be closer to the end surface 2*b* of the element body 2. A pair of terminal electrodes 4 and 5 is separated from each other in the second direction D2. Each of the terminal electrodes 4 and 5 is embedded in the element body 2. Each of the terminal electrodes 4 and 5 is disposed in a recess portion formed in the element body 2. The terminal electrode 4 is disposed over the end surface 2*a* and the principal surface 2*c*. The terminal electrode 5 is disposed over the end surface 2*b* and the principal surface 2*c*. In the present embodiment, a surface of the terminal electrode 4 is substantially flush with each of the end surface 2*a* and the principal surface 2*c*. A surface of the terminal electrode 5 is substantially flush with each of the end surface 2*b* and the principal surface 2*c*.

Each of the terminal electrodes 4 and 5 includes a conductive material. The conductive material includes Ag or Pd, for example. Each of the terminal electrodes 4 and 5 includes a sintered body of conductive paste including conductive material powder. The conductive material powder includes Ag powder or Pd powder, for example. A plating layer may be formed on the surface of each of the terminal electrodes 4 and 5. The plating layer is formed by electroplating or electroless plating, for example. The plating layer includes Ni, Sn, or Au, for example.

The terminal electrode 4 has an L shape when viewed from the third direction D3. The terminal electrode 4 includes a plurality of electrode portions 4*a* and 4*b*. In the present embodiment, the terminal electrode 4 includes a pair of electrode portions 4*a* and 4*b*. The electrode portion 4*a* and the electrode portion 4*b* are coupled at the ridge portion of the element body 2 and are electrically connected to each other. In the present embodiment, the electrode portion 4*a* and the electrode portion 4*b* are integrally formed. The electrode portion 4*a* extends along the first direction D1. The electrode portion 4*a* has a rectangular shape when viewed from the second direction D2. The electrode portion 4*b* extends along the second direction D2. The electrode portion 4*b* has a rectangular shape when viewed from the first direction D1. Each of the electrode portions 4*a* and 4*b* extends along the third direction D3.

As illustrated in FIG. 2, the terminal electrode 4 is configured by laminating a plurality of electrode layers 10. In the present embodiment, the terminal electrode 4 includes the plurality of laminated electrode layers 10. In the present embodiment, the number of electrode layers 10 is "13". Each electrode layer 10 is provided in a missing portion formed in the corresponding insulator layer 6. The electrode layer 10 is formed by firing the conductive paste located in the missing portion formed in the green sheet. The green sheet and the conductive paste are simultaneously fired. Therefore, when the insulator layer 6 is obtained from the green sheet, the electrode layer 10 is obtained from the conductive paste. In the actual terminal electrode 4, the electrode layers 10 are integrated in such a manner that boundaries between the electrode layers 10 cannot be visualized. The recess portion of the element body 2 after firing, in which the terminal electrode 4 is disposed, is obtained by the missing portion formed in the green sheet.

Each electrode layer 10 has an L shape when viewed from the third direction D3. The electrode layer 10 includes a plurality of layer portions 10*a* and 10*b*. In the present embodiment, the electrode layer 10 includes a pair of layer portions 10*a* and 10*b*. The layer portion 10*a* extends along the first direction D1. The layer portion 10*b* extends along the second direction D2. The electrode portion 4*a* is configured by laminating the layer portions 10*a* of the electrode layers 10. In the electrode portion 4*a*, the layer portions 10*a* are integrated in such a manner that boundaries between the layer portions 10*a* cannot be visualized. The electrode portion 4*b* is configured by laminating the layer portions 10*b* of the electrode layers 10. In the electrode portion 4*b*, the layer portions 10*b* are integrated in such a manner that boundaries between the layer portions 10*b* cannot be visualized.

The terminal electrode 5 has an L shape when viewed from the third direction D3. The terminal electrode 5 includes a plurality of electrode portions 5*a* and 5*b*. In the present embodiment, the terminal electrode 5 includes a pair of electrode portions 5*a* and 5*b*. The electrode portion 5*a* and the electrode portion 5*b* are coupled at the ridge portion of the element body 2 and are electrically connected to each other. In the present embodiment, the electrode portion 5*a* and the electrode portion 5*b* are integrally formed. The electrode portion 5*a* extends along the first direction D1. The electrode portion 5*a* has a rectangular shape when viewed from the second direction D2. The electrode portion 5*b* extends along the second direction D2. The electrode portion 5*b* has a rectangular shape when viewed from the first direction D1. Each of the electrode portions 5*a* and 5*b* extends along the third direction D3.

As illustrated in FIG. 2, the terminal electrode 5 is configured by laminating a plurality of electrode layers 11. In the present embodiment, the terminal electrode 5 includes a plurality of laminated electrode layers 11. In the present embodiment, the number of electrode layers 11 is "13". Each electrode layer 11 is provided in a missing portion formed in the corresponding insulator layer 6. The electrode layer 11 is formed by firing the conductive paste located in the missing portion fainted in the green sheet. As described above, the green sheet and the conductive paste are simultaneously fired. Therefore, when the insulator layer 6 is obtained from the green sheet, the electrode layer 10 is obtained and the electrode layer 11 is obtained from the conductive paste. In the actual terminal electrode 5, the electrode layers 11 are integrated in such a manner that boundaries between the electrode layers 11 cannot be visualized. The recess portion of the element body 2 after firing, in which the terminal electrode 5 is disposed, is obtained by the missing portion formed in the green sheet.

Each electrode layer 11 has an L shape when viewed from the third direction D3. The electrode layer 11 includes a plurality of layer portions 11*a* and 11*b*. In the present embodiment, the electrode layer 11 includes a pair of layer portions 11*a* and 11*b*. The layer portion 11*a* extends along the first direction D1. The layer portion 11*b* extends along the second direction D2. The electrode portion 5*a* is configured by laminating the layer portions 11*a* of the electrode layers 11. In the electrode portion 5*a*, the layer portions 11*a* are integrated in such a manner that boundaries between the layer portions 11*a* cannot be visualized. The electrode portion 5*b* is configured by laminating the layer portions 11*b* of the electrode layers 11. In the electrode portion 5*b*, the layer portions 11*b* are integrated in such a manner that boundaries between the layer portions 11*b* cannot be visualized.

The multilayer coil component 1 includes a coil 7 disposed in the element body 2, as illustrated in FIG. 3. As illustrated in FIG. 2, the coil 7 includes a plurality of coil conductors 21, 23, 25, and 27 and a plurality of coil conductors 31, 33, and 35. In the present embodiment, the coil 7 includes four coil conductors 21, 23, 25, and 27 and three coil conductors 31, 33, and 35. The coil conductors 21 to 27 and 31 to 35 are disposed in the order of the coil conductor 21, the coil conductor 31, the coil conductor 23, the coil conductor 33, the coil conductor 25, the coil conductor 35, and the coil conductor 27 along the third direction D3. The coil conductors 21 to 27 and the coil conductors 31 to 35 are alternately disposed in the third direction D3. Each of the coil conductors 21 to 27 and 31 to 35 substantially has a shape in which a part of a loop is broken, and includes one end and another end. A coil axis of the coil 7 extends along the third direction D3. Each of the coil conductors 21 to 27 and 31 to 35 includes a loop portion and the one end and the other end respectively extending from the loop portion.

As also illustrated in FIG. 3, an inner diameter of each of the coil conductor 31, 33, and 35 is smaller than an inner diameter of each of the coil conductors 21, 23, 25, and 27. For example, in a case in which each of the coil conductors 21, 23, 25, and 27 constitutes a first coil conductors, each of the coil conductors 31, 33, and 35 constitutes a second coil conductors. The inner diameter of each of the coil conductors 31, 33, and 35 is defined as follows, for example.

After obtaining an area of a region located inside the coil conductors 31, 33, and 35 (loop portions) when viewed from the third direction D3, a circle equivalent diameter of the area is calculated. The calculated circle equivalent diameter defines the inner diameter of each of the coil conductors 31, 33, and 35. In the region located inside the coil conductors 31, 33, and 35 when viewed from the third direction D3, a minimum length of a line segment passing through the coil axis and connecting two places opposing each other with the coil axis therebetween may define the inner diameter of each of the coil conductors 31, 33, and 35. A maximum length of the line segment described above may define the inner diameter of each of the coil conductors 31, 33, and 35.

After obtaining an area of a region located inside the coil conductors 21, 23, 25, and 27 (loop portions) when viewed from the third direction D3, a circle equivalent diameter of the area is calculated. The calculated circle equivalent diameter defines the inner diameter of each of the coil conductors 21, 23, 25, and 27. In the region located inside the coil conductors 21, 23, 25, and 27 when viewed from the third direction D3, a minimum length of a line segment passing through the coil axis and connecting two places opposing each other with the coil axis therebetween may define the inner diameter of each of the coil conductors 21, 23, 25, and 27. A maximum length of the line segment described above may define the inner diameter of each of the coil conductors 21, 23, 25, and 27.

For example, in a case in which the inner diameter of each of the coil conductors 21, 23, 25, and 27 is a first inner diameter, the inner diameter of each of the coil conductors 31, 33, and 35 is a second inner diameter.

The loop portion of each of the coil conductors 31, 33, and 35 is located in the region located inside the coil conductors 21, 23, 25, and 27 (loop portions) when viewed from the third direction D3. In the present embodiment, the entire loop portion of each of the coil conductors 31, 33, and 35 is located in the region located inside the coil conductors 21, 23, 25, and 27 when viewed from the third direction D3. A shape of the region located inside the coil conductors 31, 33, and 35 and a shape of the region located inside the coil conductors 21, 23, 25, and 27 are polygonal. The shape of the region located inside the coil conductors 31, 33, and 35 and the shape of the region located inside the coil conductors 21, 23, 25, and 27 may not be polygonal, and may be circular, for example. The region located inside the coil conductors 31, 33, and 35 and the region located inside the coil conductors 21, 23, 25, and 27 are similar. The region located inside the coil conductors 31, 33, and 35 and the region located inside the coil conductors 21, 23, 25, and 27 may not be similar.

The coil conductor 21 is located in the same layer as one electrode layer 10 and one electrode layer 11. The coil conductor 21 is coupled to the electrode layer 11 via a connection conductor 41. The connection conductor 41 is located in the same layer as the coil conductor 21. The one end of the coil conductor 21 is connected to the connection conductor 41. The one end of the coil conductor 21 extends toward the outside of the coil conductor 21 when viewed from the third direction D3. The connection conductor 41 is connected to the layer portion 11*a*. The connection conductor 41 connects the coil conductor 21 and the electrode layer 11. The connection conductor 41 may be connected to the layer portion 11*b*. The other end of the coil conductor 21 extends toward the inside of the coil conductor 21 when viewed from the third direction D3. The coil conductor 21 is separated from the electrode layer 10 located in the same layer as the coil conductor 21. In the present embodiment, the coil conductor 21, the connection conductor 41, and the electrode layer 11 are integrally fox med.

The coil conductor 31 is located in the same layer as one electrode layer 10 and one electrode layer 11. Both ends of the coil conductor 31 extend toward the outside of the coil conductor 31 when viewed from the third direction D3. The coil conductor 31 is separated from the electrode layers 10 and 11 located in the same layer as the coil conductor 31. The coil conductor 21 and the coil conductor 31 are adjacent to each other in the third direction D3, in a state in which the insulator layer 6 is interposed between the coil conductor 21 and the coil conductor 31. When viewed from the third direction D3, the other end of the coil conductor 21 and the one end of the coil conductor 31 overlap each other. In the present embodiment, when viewed from the third direction D3, the whole of the other end of the coil conductor 21 and the whole of the one end of the coil conductor 31 overlap each other.

In the same layer as the insulator layer 6 located between the coil conductor 21 and the coil conductor 31, a connection conductor 42, one electrode layer 10, and one electrode layer 11 are located. The connection conductor 42 is separated from the electrode layers 10 and 11 located in the same layer as the connection conductor 42. The connection conductor 42 is connected to the other end of the coil conductor 21 and is connected to the one end of the coil conductor 31. The connection conductor 42 couples the coil conductor 21 and the coil conductor 31.

As illustrated in FIG. 3, the connection conductor 42 has a shape along the coil conductor 21 and the coil conductor 31. The connection conductor 42 is disposed in such a manner as to overlap the other end of the coil conductor 21 and the one end of the coil conductor 31 when viewed from the third direction D3. The connection conductor 42 extends in a direction in which the other end of the coil conductor 21 and the one end of the coil conductor 31 extend. In the present embodiment, the entire connection conductor 42 overlaps the other end of the coil conductor 21 and the one end of the coil conductor 31 when viewed from the third direction D3. A width of the connection conductor 42 is equivalent to the widths of the coil conductors 21 and 31. In the present specification, "equivalent" does not necessarily mean only that values are matched. Even if values include a slight difference in a predetermined range, a manufacturing error, or a measurement error, the values may be equivalent.

The coil conductor 23 is located in the same layer as one electrode layer 10 and one electrode layer 11. The one end of the coil conductor 23 extends toward the inside of the coil conductor 23 when viewed from the third direction D3. The other end of the coil conductor 23 extends in such a manner as to overlap the coil conductors 21, 25, and 27 when viewed from the third direction D3. The coil conductor 23 is separated from the electrode layers 10 and 11 located in the same layer as the coil conductor 23. The coil conductor 31 and the coil conductor 23 are adjacent to each other in the third direction D3, in a state in which the insulator layer 6 is interposed between the coil conductor 31 and the coil conductor 23. When viewed from the third direction D3, the other end of the coil conductor 31 and the one end of the coil conductor 23 overlap each other. In the present embodiment, when viewed from the third direction D3, the whole of the other end of the coil conductor 31 and the whole of the one end of the coil conductor 23 overlap each other.

In the same layer as the insulator layer 6 located between the coil conductor 31 and the coil conductor 23, a connection conductor 43, one electrode layer 10, and one electrode layer 11 are located. The connection conductor 43 is separated from the electrode layers 10 and 11 located in the same layer as the connection conductor 43. The connection conductor 43 is connected to the other end of the coil conductor 31 and is connected to the one end of the coil conductor 23. The connection conductor 43 couples the coil conductor 31 and the coil conductor 23.

As illustrated in FIG. 3, the connection conductor 43 has a shape along the coil conductor 31 and the coil conductor 23. The connection conductor 43 is disposed in such a manner as to overlap the other end of the coil conductor 31 and the one end of the coil conductor 23 when viewed from the third direction D3. The connection conductor 43 extends in a direction in which the other end of the coil conductor 31 and the one end of the coil conductor 23 extend. In the present embodiment, the entire connection conductor 43 overlaps the other end of the coil conductor 31 and the one end of the coil conductor 23 when viewed from the third direction D3. A width of the connection conductor 43 is equivalent to the widths of the coil conductors 31 and 23. In the present embodiment, the connection conductor 43 does not overlap the connection conductor 42 when viewed from the third direction D3.

The coil conductor 33 is located in the same layer as one electrode layer 10 and one electrode layer 11. Both ends of the coil conductor 33 extend toward the outside of the coil conductor 33 when viewed from the third direction D3. The coil conductor 33 is separated from the electrode layers 10 and 11 located in the same layer as the coil conductor 33. The coil conductor 23 and the coil conductor 33 are adjacent to each other in the third direction D3, in a state in which the insulator layer 6 is interposed between the coil conductor 23 and the coil conductor 33. When viewed from the third direction D3, the other end of the coil conductor 23 and the one end of the coil conductor 33 overlap each other. In the present embodiment, when viewed from the third direction D3, the whole of the other end of the coil conductor 23 and the whole of the one end of the coil conductor 33 overlap each other.

In the same layer as the insulator layer 6 located between the coil conductor 23 and the coil conductor 33, a connection conductor 44, one electrode layer 10, and one electrode layer 11 are located. The connection conductor 44 is separated from the electrode layers 10 and 11 located in the same layer as the connection conductor 44. The connection conductor 44 is connected to the other end of the coil conductor 23 and is connected to the one end of the coil conductor 33. The connection conductor 44 couples the coil conductor 23 and the coil conductor 33.

As illustrated in FIG. 3, the connection conductor 44 has a shape along the coil conductor 23 and the coil conductor 33. The connection conductor 44 is disposed in such a manner as to overlap the other end of the coil conductor 23 and the one end of the coil conductor 33 when viewed from the third direction D3. The connection conductor 44 extends in a direction in which the other end of the coil conductor 23 and the one end of the coil conductor 34 extend. In the present embodiment, the entire connection conductor 44 overlaps the other end of the coil conductor 23 and the one end of the coil conductor 33 when viewed from the third direction D3. A width of the connection conductor 44 is equivalent to the widths of the coil conductors 23 and 33. In the present embodiment, the connection conductor 44 does not overlap the connection conductors 42 and 43 when viewed from the third direction D3.

The coil conductor 25 is located in the same layer as one electrode layer 10 and one electrode layer 11. The one end of the coil conductor 25 extends in such a manner as to overlap the coil conductors 21, 23, and 27 when viewed from the third direction D3. The other end of the coil conductor 25 extends toward the inside of the coil conductor 25 when viewed from the third direction D3. The coil conductor 25 is separated from the electrode layers 10 and 11 located in the same layer as the coil conductor 25. The coil conductor 33 and the coil conductor 25 are adjacent to each other in the third direction D3, in a state in which the insulator layer 6 is interposed between the coil conductor 33 and the coil conductor 25. When viewed from the third direction D3, the other end of the coil conductor 33 and the one end of the coil conductor 25 overlap each other. In the present embodiment, when viewed from the third direction D3, the whole of the other end of the coil conductor 33 and the whole of the one end of the coil conductor 25 overlap each other.

In the same layer as the insulator layer 6 located between the coil conductor 33 and the coil conductor 25, a connection conductor 45, one electrode layer 10, and one electrode layer 11 are located. The connection conductor 45 is separated from the electrode layers 10 and 11 located in the same layer as the connection conductor 45. The connection conductor 45 is connected to the other end of the coil conductor 33 and is connected to the one end of the coil conductor 25. The connection conductor 45 couples the coil conductor 33 and the coil conductor 25.

As illustrated in FIG. 3, the connection conductor 45 has a shape along the coil conductor 33 and the coil conductor 25. The connection conductor 45 is disposed in such a manner as to overlap the other end of the coil conductor 33 and the one end of the coil conductor 25 when viewed from the third direction D3. The connection conductor 45 extends in a direction in which the other end of the coil conductor 33 and the one end of the coil conductor 25 extend. In the present embodiment, the entire connection conductor 45 overlaps the other end of the coil conductor 33 and the one end of the coil conductor 25 when viewed from the third direction D3. A width of the connection conductor 45 is equivalent to the widths of the coil conductors 33 and 25. In the present embodiment, the connection conductor 45 does not overlap the connection conductors 42, 43, and 44 when viewed from the third direction D3.

The coil conductor 35 is located in the same layer as one electrode layer 10 and one electrode layer 11. Both ends of the coil conductor 35 extend toward the outside of the coil conductor 35 when viewed from the third direction D3. The coil conductor 35 is separated from the electrode layers 10 and 11 located in the same layer as the coil conductor 35. The coil conductor 25 and the coil conductor 35 are adjacent to each other in the third direction D3, in a state in which the insulator layer 6 is interposed between the coil conductor 25 and the coil conductor 35. When viewed from the third direction D3, the other end of the coil conductor 25 and the one end of the coil conductor 35 overlap each other. In the present embodiment, when viewed from the third direction D3, the whole of the other end of the coil conductor 25 and the whole of the one end of the coil conductor 35 overlap each other.

In the same layer as the insulator layer 6 located between the coil conductor 25 and the coil conductor 35, a connection conductor 46, one electrode layer 10, and one electrode layer 11 are located. The connection conductor 46 is separated from the electrode layers 10 and 11 located in the same layer as the connection conductor 46. The connection conductor 46 is connected to the other end of the coil conductor 25 and is connected to the one end of the coil conductor 35. The connection conductor 46 couples the coil conductor 25 and the coil conductor 35.

As illustrated in FIG. 3, the connection conductor 46 has a shape along the coil conductor 25 and the coil conductor 35. The connection conductor 46 is disposed in such a manner as to overlap the other end of the coil conductor 25 and the one end of the coil conductor 35 when viewed from the third direction D3. The connection conductor 46 extends in a direction in which the other end of the coil conductor 25 and the one end of the coil conductor 35 extend. In the present embodiment, the entire connection conductor 46 overlaps the other end of the coil conductor 25 and the one end of the coil conductor 35 when viewed from the third direction D3. A width of the connection conductor 46 is equivalent to the widths of the coil conductors 25 and 35. In the present embodiment, the connection conductor 46 overlaps the connection conductor 42 when viewed from the third direction D3.

The coil conductor 27 is located in the same layer as one electrode layer 10 and one electrode layer 11. The one end of the coil conductor 27 extends toward the inside of the coil conductor 27 when viewed from the third direction D3. The coil conductor 21 is coupled to the electrode layer 10 via a connection conductor 48. The connection conductor 48 is located in the same layer as the coil conductor 27. The other end of the coil conductor 27 is connected to the connection conductor 48. The other end of the coil conductor 27 extends toward the outside of the coil conductor 21 when viewed from the third direction D3. The connection conductor 48 is connected to the layer portion 10*a*. The connection conductor 48 connects the coil conductor 27 and the electrode layer 10. The connection conductor 48 may be connected to the layer portion 10*b*. The coil conductor 27 is separated from the electrode layer 11 located in the same layer as the coil conductor 27. In the present embodiment, the coil conductor 27, the connection conductor 48, and the electrode layer 10 are integrally formed. The coil conductor 35 and the coil conductor 27 are adjacent to each other in the third direction D3, in a state in which the insulator layer 6 is interposed between the coil conductor 35 and the coil conductor 27. When viewed from the third direction D3, the other end of the coil conductor 35 and the one end of the coil conductor 27 overlap each other. In the present embodiment, when viewed from the third direction D3, the whole of the other end of the coil conductor 35 and the whole of the one end of the coil conductor 27 overlap each other.

In the same layer as the insulator layer 6 located between the coil conductor 35 and the coil conductor 27, a connection conductor 47, one electrode layer 10, and one electrode layer 11 are located. The connection conductor 47 is separated from the electrode layers 10 and 11 located in the same layer as the connection conductor 47. The connection conductor 47 is connected to the other end of the coil conductor 35 and is connected to the one end of the coil conductor 27. The connection conductor 47 couples the coil conductor 35 and the coil conductor 27.

As illustrated in FIG. 3, the connection conductor 47 has a shape along the coil conductor 35 and the coil conductor 27. The connection conductor 47 is disposed in such a manner as to overlap the other end of the coil conductor 35 and the one end of the coil conductor 27 when viewed from the third direction D3. The connection conductor 47 extends in a direction in which the other end of the coil conductor 35 and the one end of the coil conductor 27 extend. In the present embodiment, the entire connection conductor 47 overlaps the other end of the coil conductor 35 and the one end of the coil conductor 27 when viewed from the third direction D3. A width of the connection conductor 47 is equivalent to the widths of the coil conductors 35 and 27. In the present embodiment, the connection conductor 47 overlaps the connection conductor 43 when viewed from the third direction D3. The connection conductor 47 does not overlap the connection conductor 46 when viewed from the third direction D3.

The coil conductors 21 to 27 and 31 to 35 are electrically connected via the connection conductors 42 to 47. The coil conductors 21 to 27 and 31 to 35 constitute the coil 7. The coil 7 includes the plurality of connection conductors 42 to 47. The coil 7 is electrically connected to the terminal electrode 5 via the connection conductor 41. The coil 7 is electrically connected to the terminal electrode 4 via the connection conductor 48.

Each of the coil conductors 21 to 27 and 31 to 35 and each of the connection conductors 41 to 48 include a conductive material. The conductive material includes Ag or Pd. Each of the coil conductors 21 to 27 and 31 to 35 and each of the connection conductors 41 to 48 includes a sintered body of conductive paste including conductive material powder. The conductive material powder includes Ag powder or Pd powder, for example. In the present embodiment, each of the coil conductors 21 to 27 and 31 to 35 and each of the connection conductors 41 to 48 include the same conductive material as that of each of the terminal electrodes 4 and 5. Each of the coil conductors 21 to 27 and 31 to 35 and each of the connection conductors 41 to 48 may include a conductive material different from that of each of the terminal electrodes 4 and 5.

Each of the coil conductors 21 to 27 and 31 to 35 and each of the connection conductors 41 to 48 are provided in a missing portion formed in the corresponding insulator layer 6. Each of the coil conductors 21 to 27 and 31 to 35 and each of the connection conductors 41 to 48 are formed by firing the conductive paste located inside the missing portion formed in the green sheet. As described above, the green sheet and the conductive paste are simultaneously fired. Therefore, when the insulator layer 6 is obtained from the green sheet, each of the coil conductors 21 to 27 and 31 to 35 and each of the connection conductors 41 to 48 are obtained from the conductive paste.

The missing portion formed in the green sheet is formed by the following process, for example.

First, the green sheet is formed by applying element body paste including a constituent material of the insulator layer 6 and a photosensitive material onto a base material. The base material is a PET film, for example. The photosensitive material included in the element body paste may be of either a negative type or a positive type, and known materials can be used. Next, the green sheet is exposed and developed by a photolithographic method using a mask corresponding to the missing portion, and the missing portion is formed in the green sheet on the base material. The green sheet provided with the missing portion is an element body pattern.

The electrode layers 10 and 11, the coil conductors 21 to 27 and 31 to 35, and the connection conductors 41 to 48 are formed by the following process, for example.

First, a conductor material layer is formed by applying conductive paste including a photosensitive material onto a base material. The photosensitive material included in the conductive paste may be of either a negative type or a positive type, and known materials can be used. Next, the conductor material layer is exposed and developed by a photolithographic method using a mask corresponding to the missing portion, and a conductor pattern corresponding to a shape of the missing portion is formed on the base material.

The multilayer coil component 1 is obtained by the following process subsequent to the processes described above, for example.

By combining the conductor pattern with the missing portion of the element body pattern, a sheet in which the element body pattern and the conductor pattern are located in the same layer is prepared. After a heat treatment of a laminate obtained by laminating a predetermined number of prepared sheets, a plurality of green chips are obtained from the laminate. In this process, for example, the green laminate is cut in a chip shape by a cutting machine. Consequently, the plurality of green chips having a predetermined size are obtained.

Next, the green chips are fired. The multilayer coil component 1 is obtained by the firing. In the multilayer coil component 1, the terminal electrodes 4 and 5 and the coil 7 are integrally formed.

As described above, in the present embodiment, the inner diameter of each of the coil conductors 31, 33, and 35 is smaller than the inner diameter of each of the coil conductors 21, 23, 25, and 27. Therefore, in the multilayer coil component 1, as compared with a configuration in which the inner diameters of all the coil conductors 21 to 27 and 31 to 35 are the same, an interval between the coil conductors 21 to 27 and 31 to 35 adjacent to each other tends not to narrow. Consequently, the coil conductors 21, 23, 25, and 27 and the coil conductors 31, 33, and 35 tend not to short-circuit.

In the present embodiment, the connection conductors 42 to 47 have a shape along the coil conductors 21 to 27 and the coil conductors 31 to 35. In a configuration in which the connection conductors 42 to 47 have the shape along the coil conductors 21 to 27 and the coil conductors 31 to 35, for example, lengths of the connection conductors 42 to 47 in the direction along the coil conductors 21 to 27 and the coil conductors 31 to 35 are increased, so that connectivity between the coil conductors 21 to 27 and 31 to 35 and the connection conductors 42 to 47 is secured. Therefore, in the multilayer coil component 1, even in a case in which the connectivity between the coil conductors 21 to 27 and 31 to 35 and the connection conductors 42 to 47 is secured, the connection conductors 42 to 47 tend not to extend to the inside of the coil 7. Consequently, the multilayer coil component 1 suppresses reduction of an inductance value.

In the present embodiment, the connection conductors 42 to 47 do not extend into the region located inside the coil conductors 31, 33, and 35 (loop portions). Therefore, the multilayer coil component 1 further suppresses the reduction of the inductance value.

Figure 4:
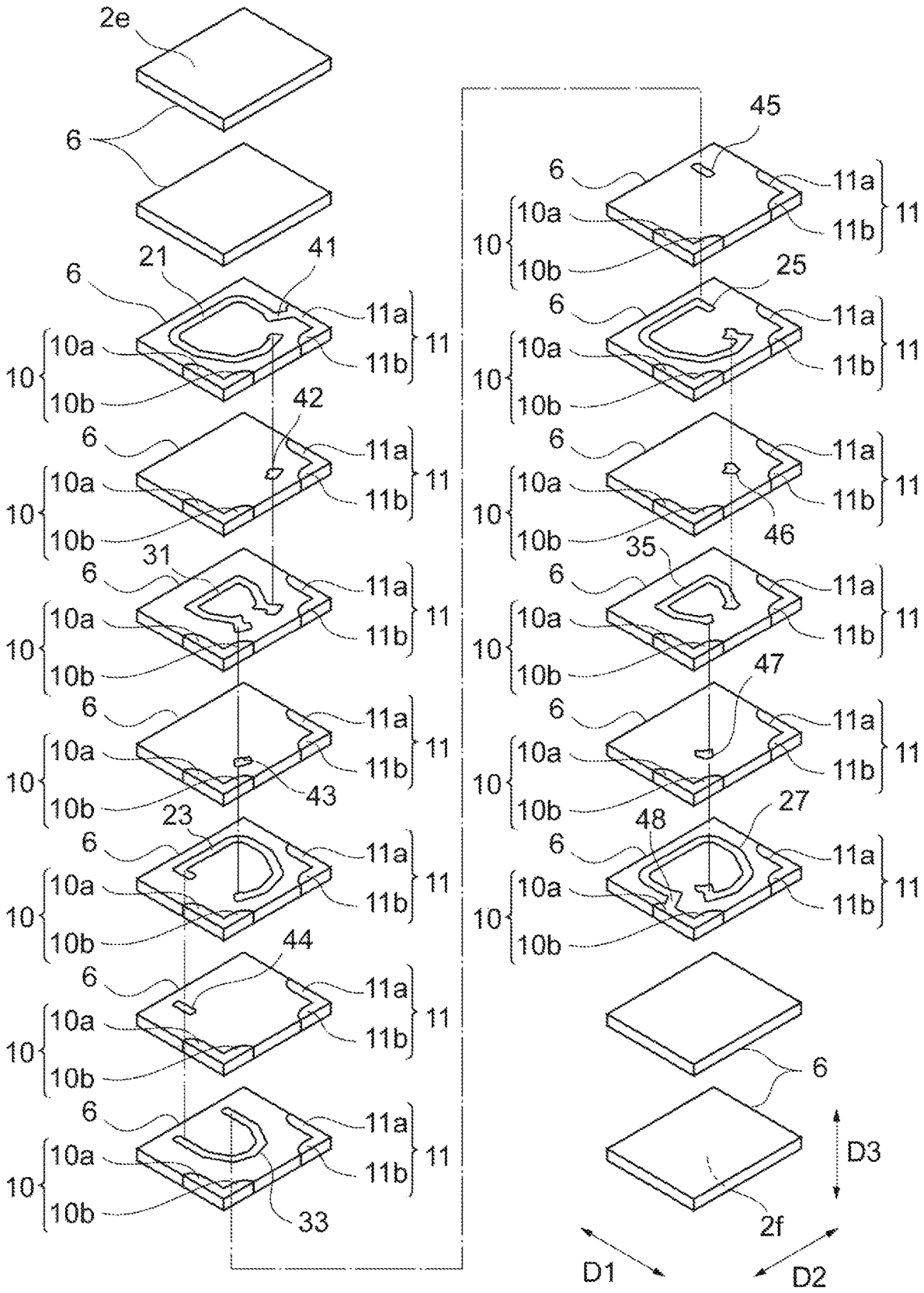
FIG. 4 is an exploded perspective view illustrating configurations of an element body, coil conductors, and connection conductors included in a multilayer coil component according to a modification of the present embodiment.
Figure 5:
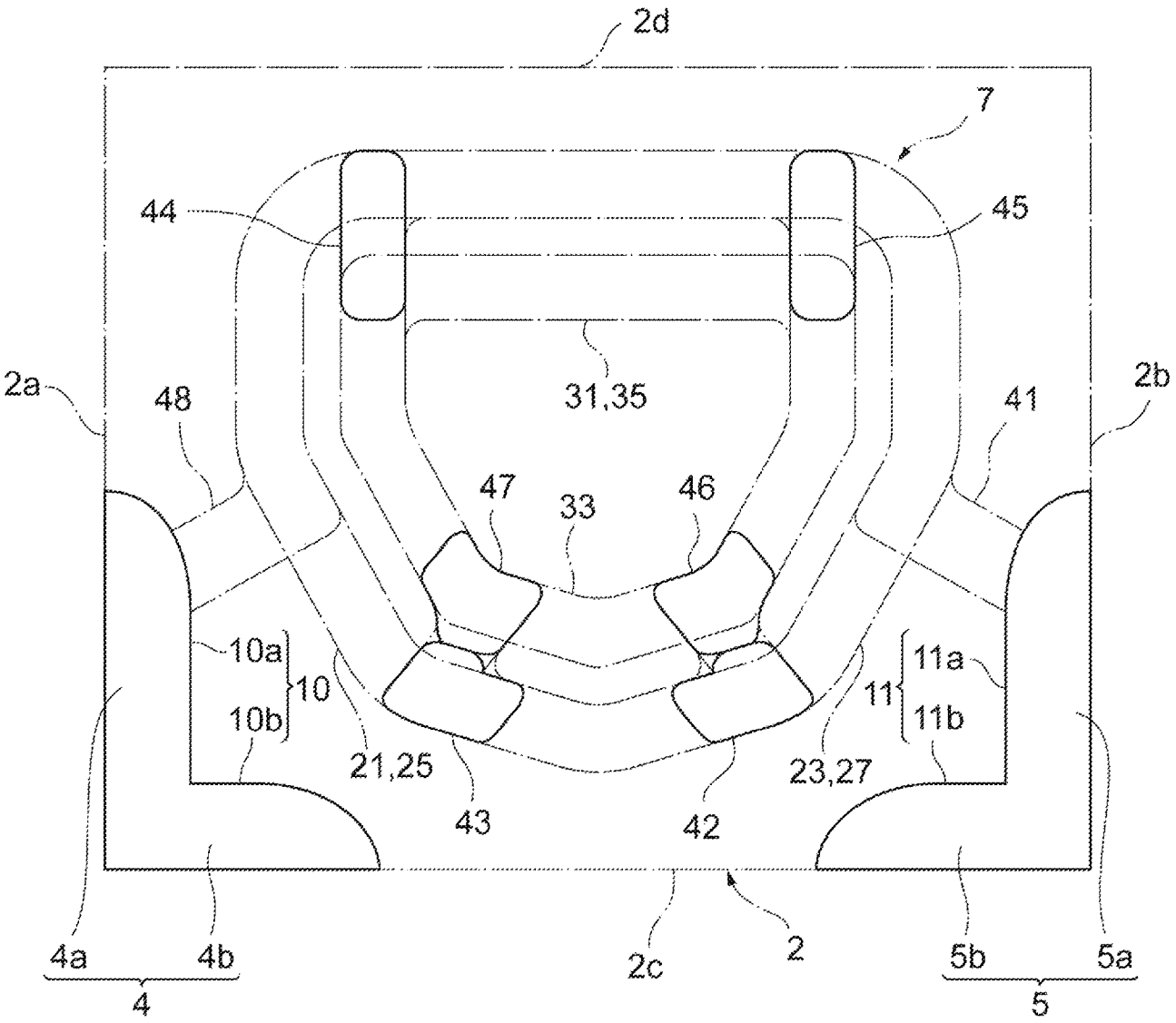
FIG. 5 is a diagram illustrating terminal electrodes, coil conductors, and connection conductors.

Next, a configuration of a multilayer coil component according to a modification of the present embodiment will be described with reference to FIGS. 4 and 5. FIG. 4 is an exploded perspective view illustrating configurations of an element body, coil conductors, and connection conductors included in the multilayer coil component according to the present modification. FIG. 5 is a diagram illustrating terminal electrodes, coil conductors, and connection conductors. The multilayer coil component according to the present modification is generally similar to or the same as the multilayer coil component 1 described above. However, the present modification is different from the embodiment described above in the configurations of the connection conductors 42 to 47. Hereinafter, a difference between the embodiment and the modification will be mainly described.

Like the multilayer coil component 1, the multilayer coil component according to the present modification includes the element body 2, the pair of terminal electrodes 4 and 5, and the coil 7. The coil 7 includes the plurality of coil conductors 21, 23, 25, and 27, the plurality of coil conductors 31, 33, and 35, and the plurality of connection conductors 41 to 48.

The connection conductor 42 couples the coil conductor 21 and the coil conductor 31. The one end of the coil conductor 31 includes a first portion and a second portion. The first portion extends toward the outside of the coil conductor 31. The second portion extends in such a manner as to overlap the loop portion of the coil conductor 21 when viewed from the third direction D3. In the coil conductor 31, the first portion is located between the loop portion and the second portion. The connection conductor 42 is disposed in such a manner as to overlap the loop portion and the other end of the coil conductor 21 and the first and second portions of the coil conductor 31 when viewed from the third direction D3. The connection conductor 42 may be disposed in such a manner as to overlap the loop portion of the coil conductor 21 and the second portion of the coil conductor 31 when viewed from the third direction D3.

The connection conductor 43 couples the coil conductor 31 and the coil conductor 23. The other end of the coil conductor 31 includes a third portion and a fourth portion. The third portion extends toward the outside of the coil conductor 31. The fourth portion extends in such a manner as to overlap the loop portion of the coil conductor 23 when viewed from the third direction D3. In the coil conductor 31, the third portion is located between the loop portion and the fourth portion. The connection conductor 43 is disposed in such a manner as to overlap the third and fourth portions of the coil conductor 31 and the loop portion and the one end of the coil conductor 23 when viewed from the third direction D3. The connection conductor 43 may be disposed in such a manner as to overlap the fourth portion of the coil conductor 31 and the loop portion of the coil conductor 23 when viewed from the third direction D3.

The connection conductor 46 couples the coil conductor 25 and the coil conductor 35. The other end of the coil conductor 25 includes a fifth portion and a sixth portion. The fifth portion extends toward the inside of the coil conductor 25. The sixth portion extends in such a manner as to overlap the loop portion of the coil conductor 35 when viewed from the third direction D3. In the coil conductor 25, the fifth portion is located between the loop portion and the sixth portion. The connection conductor 46 is disposed in such a manner as to overlap the fifth and sixth portions of the coil conductor 25 and the other end and the loop portion of the coil conductor 35 when viewed from the third direction D3. The connection conductor 46 may be disposed in such a manner as to overlap the sixth portion of the coil conductor 25 and the loop portion of the coil conductor 35 when viewed from the third direction D3.

The connection conductor 47 couples the coil conductor 35 and the coil conductor 27. The one end of the coil conductor 27 includes a seventh portion and an eighth portion. The seventh portion extends toward the inside of the coil conductor 27. The eighth portion extends in such a manner as to overlap the loop portion of the coil conductor 35 when viewed from the third direction D3. In the coil conductor 27, the seventh portion is located between the loop portion and the eighth portion. The connection conductor 47 is disposed in such a manner as to overlap the other end and the loop portion of the coil conductor 35 and the seventh and eighth portions of the coil conductor 35 when viewed from the third direction D3. The connection conductor 47 may be disposed in such a manner as to overlap the loop portion of the coil conductor 35 and the eighth portion of the coil conductor 27 when viewed from the third direction D3.

In the present modification, the connection conductor 42 does not overlap the connection conductor 46 when viewed from the third direction D3. In the present modification, the connection conductor 43 does not overlap the connection conductor 47 when viewed from the third direction D3. Therefore, in the present modification, the connection conductors 42 to 47 do not overlap each other when viewed from the third direction D3.

Like the embodiment described above, even in the present modification, an inner diameter of each of the coil conductors 31, 33, and 35 is smaller than an inner diameter of each of the coil conductors 21, 23, 25, and 27. Therefore, the coil conductors 21, 23, 25, and 27 and the coil conductors 31, 33, and 35 tend not to short-circuit. Like the multilayer coil component 1, in the multilayer coil component according to the present modification, the connection conductors 42 to 47 have the shape along the coil conductors 21 to 27 and the coil conductors 31 to 35. Therefore, the multilayer coil component according to the present modification suppresses the reduction of the inductance value.

In the present modification, the connection conductors 42 to 47 do not overlap each other when viewed from the third direction D3. Therefore, in regions of the coil conductors 21 to 27 and 31 to 35 overlapping the connection conductors 42 to 47 when viewed from the third direction D3, the interval between the coil conductors 21 to 27 and 31 to 35 adjacent to each other tends not to narrow.

Consequently, the multilayer coil component according to the present modification further suppresses short-circuiting between the coil conductors 21, 23, 25, and 27 and the coil conductors 31, 33, and 35.

In the embodiment and the modification, the connection conductors 42 to 47 are different from so-called through-hole conductors. The through-hole conductor is formed by sintering conductive paste filled into a through-hole formed by laser processing, for example. The connection conductors 42 to 47 do not have a cylindrical shape or a frustum shape, and have the shape along the coil conductors 21 to 27 and the coil conductors 31 to 35 as described above. In the embodiment and the modification, the thicknesses of the connection conductors 42 to 47 are smaller than the widths of the connection conductors 42 to 47 and is smaller than the lengths of the connection conductors 42 to 47.

For example, the present embodiment and the present modification disclose the following notes.

(Note 1)

A multilayer coil component comprising:

an element body including a plurality of laminated insulator layers; and a coil disposed in the element body, wherein the coil includes at least one first coil conductor having a first inner diameter, at least one second coil conductor having a second inner diameter smaller than the first inner diameter and being adjacent to the at least one first coil conductor in a direction in which the plurality of insulator layers are laminated, and at least one connection conductor connecting the at least one first coil conductor and the at least one second coil conductor and having a shape along the at least one first coil conductor and the at least one second coil conductor.

(Note 2)

The multilayer coil component according to note 1, wherein the least one first coil conductor includes a plurality of first coil conductors, the least one second coil conductor includes a plurality second coil conductors, the least one connection conductor includes a plurality of connection conductors, the plurality of first coil conductors and the plurality of second coil conductors are alternately disposed in the direction in which the plurality of insulator layers are laminated, and the plurality of connection conductors do not overlap each other when viewed from the direction in which the plurality of insulator layers are laminated.

Although the embodiments and modifications of the present invention have been described above, the present invention is not necessarily limited to the embodiments and modifications, and the embodiment can be variously changed without departing from the scope of the invention.

The widths of the connection conductors 42 to 47 may not be equivalent to the widths of the coil conductors 21 to 27 and 31 to 35. The connection conductors 42 to 47 may extend into the regions located inside the coil conductors 31, 33, and 35 (loop portions). In a case in which the connection conductors 42 to 47 do not extend into the regions located inside the coil conductors 31, 33, and 35 (loop portions), as described above, the multilayer coil component 1 further suppresses the reduction of the inductance value.

A part of the loop portion of each of the coil conductors 31, 33, and 35 may overlap the loop portion of each of the coil conductors 21, 23, 25, and 27 when viewed from the third direction D3. For example, an outer circumferential edge of the loop portion of each of the coil conductors 31, 33, and 35 may overlap the loop portion of each of the coil conductors 21, 23, 25, and 27 when viewed from the third direction D3. A sectional shape of each of the coil conductors 21 to 27 and 31 to 35 is a shape in which the thicknesses of the coil conductors 21 to 27 and 31 to 35 decrease toward the ends of the coil conductors 21 to 27 and 31 to 35 in the width direction thereof, due to a manufacturing process (for example, a lamination process). Therefore, even in a configuration in which the part of the loop portion of each of the coil conductors 31, 33, and 35 overlaps the loop portion of each of the coil conductors 21, 23, 25, and 27 when viewed from the third direction D3, the interval between the coil conductors 21 to 27 and 31 to 35 adjacent to each other tends not to narrow.

The number of coil conductors 21 to 27 and 31 to 35 and the number of connection conductors 42 to 47 are not limited to the values described above.

The coil axis of the coil 7 may extend along the first direction D1. In this case, the direction in which the plurality of insulator layers 6 are laminated is matched with the first direction D1.

The terminal electrode 4 may have only the electrode portion 4*a* or may have only the electrode portion 4*b*. Further, the terminal electrode 5 may have only the electrode portion 5*a* or may have only the electrode portion 5*b*. Each of the terminal electrodes 4 and 5 may not be disposed in the recess portion formed in the element body 2. In this case, each of the terminal electrodes 4 and 5 is disposed on the surface of the element body in which the recess portion is not formed.

What is claimed is:

1. A multilayer coil component comprising:

an element body including a plurality of laminated insulator layers; and a coil disposed in the element body, the coil including:

a first coil conductor having a first inner diameter;

a second coil conductor having a second inner diameter smaller than the first inner diameter and being adjacent to the first coil conductor in a direction in which the plurality of insulator layers are laminated; and a connection conductor connecting the first coil conductor and the second coil conductor and having a shape along the first coil conductor and the second coil conductor, wherein an entire loop portion included in the second coil conductor is located in a region located inside the first coil conductor when viewed from the direction in which the plurality of insulator layers are laminated.

2. The multilayer coil component according to claim 1, wherein the coil includes a plurality of the first coil conductors, a plurality of the second coil conductors, and a plurality of the connection conductors, the plurality of first coil conductors and the plurality of second coil conductors are alternately disposed in the direction in which the plurality of insulator layers are laminated, and the plurality of connection conductors do not overlap each other when viewed from the direction in which the plurality of insulator layers are laminated.

3. The multilayer coil component according to claim 1, further comprising:

a terminal electrode disposed on the element body, wherein the coil is electrically connected to the terminal electrode.

* * * * *